United States Patent [19]

Halpert

[11] Patent Number: 4,662,678

[45] Date of Patent: May 5, 1987

[54] STACKABLE BOOSTER CHAIR

[75] Inventor: Stuart M. Halpert, Richmond, Va.

[73] Assignee: Marston, Inc., Richmond, Va.

[21] Appl. No.: 837,225

[22] Filed: Mar. 7, 1986

[51] Int. Cl.[4] ..... A47C 3/04

[52] U.S. Cl. ..... 297/239

[58] Field of Search ..... 297/239, 440; 108/53.3, 108/91

[56] References Cited

U.S. PATENT DOCUMENTS

| | | | |
|---|---|---|---|
| 1,408,114 | 2/1922 | Mathieu | 297/239 |
| 3,874,726 | 4/1975 | Sebel et al. | 297/239 |
| 4,056,295 | 11/1977 | Downing | 108/91 X |
| 4,341,419 | 7/1982 | Sebel | 297/239 |

*Primary Examiner*—Kenneth J. Dorner
*Assistant Examiner*—Peter R. Brown
*Attorney, Agent, or Firm*—Griffin, Branigan, & Butler

[57] ABSTRACT

A stackable children's booster chair has a pair of vertical side members spaced apart by a distance $W_1$. A vertical rabbet had a depth "d", a width $W_2$ and an upward vertical extent "e" into the lower rear portion of the inner side of each of the vertical side members. A back is located directly above the vertical rabbet and a seat extends between the vertical sides. The back has an upper portion having a thickness that is less than the width $W_2$ and extends above the side members by a distance slightly less than the vertical extent "e". The back's width $W_3$ is greater than $W_1$, but less than $(W_1+2d)$ so that a vertical rabbet of a second such booster chair is slideable over and engageable with the upper portion of the back when a second such booster chair is placed on top of the first.

23 Claims, 2 Drawing Figures

STACKABLE BOOSTER CHAIR

This invention relates to nested or stackable chairs and, more particularly, to stackable children's booster chairs.

Many types of stackable or nestable chairs are available, but most are either relatively complex and, therefore, expensive to manufacture; or, lack the sturdiness and/or attractiveness that is desirable for furniture to be used in restaurants and homes. It is an object of this invention, therefore, to provide a simple, sturdy, attractive children's booster chair that can be used both in the home and in restaurants where it is so desirable for such booster chairs to be conveniently stacked in an attractive and safe manner.

BACKGROUND

It is not uncommon for stacked pieces of furniture or the like to be keyed to each other. In such applications, however, the keys and key ways are sufficiently unattractive that they must be covered or removed when the stacked pieces are used individually. Other stackable devices such as those disclosed in Joyce U.S. Pat. No. 3,581,906 and 3,606,959 obtain alignment by engagement of back members with slots and related devices. The Joyce structures, however, require additional pin bolts or straps to prevent inadvertent horizontal motion between the stacked devices.

Other stackable devices such as those disclosed in Bush U.S. Pat. No. 3,260,396 use upwardly-projecting tabs to extend into upper containers for preventing relative transverse movement. Such structures, however, lack the simplicity and attractiveness that are required for the instant invention's booster chairs which must have their locking structures almost entirely unobservable in order to render them satisfactory for multiple use. Use, that is, as either a piece of furniture in the home or in a restaurant where it is desirable that they be conveniently and attractively stackable.

Additional advantages of the structure of the invention are that the booster chairs are easily cleaned and also provide ventilation for the child that is using the chair. Still further, when the booster chairs of the invention are stacked in a restaurant environment the seats can be used as convenient shelves to temporarily store menus or the like or to have children's favors or utensils temporarily affixed thereto so that they are immediately available to the users at the time of being seated.

SUMMARY

The booster chairs of the invention have vertical rabbets unobtrusively located on the lower rear portions of the chair's sides; and, the chair's back rest extends upwardly, above the sides, and partially outwardly over the sides. In this respect, the backrest is located directly above the rabbets which are dimensioned to receive the upwardly-extending portion of a companion chair's back rest when placed thereover. In this manner, the vertical rabbets of a second such booster chair are slidable over and engageable with the upwardly-extending portion of the adjacent chair's back rest so that a plurality of such booster chairs may be lockingly stackable upon each other.

BRIEF DESCRIPTION OF THE DRAWINGS

The foregoing other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating principles of the invention.

DETAILED DESCRIPTION OF THE DRAWINGS

Figure 1:
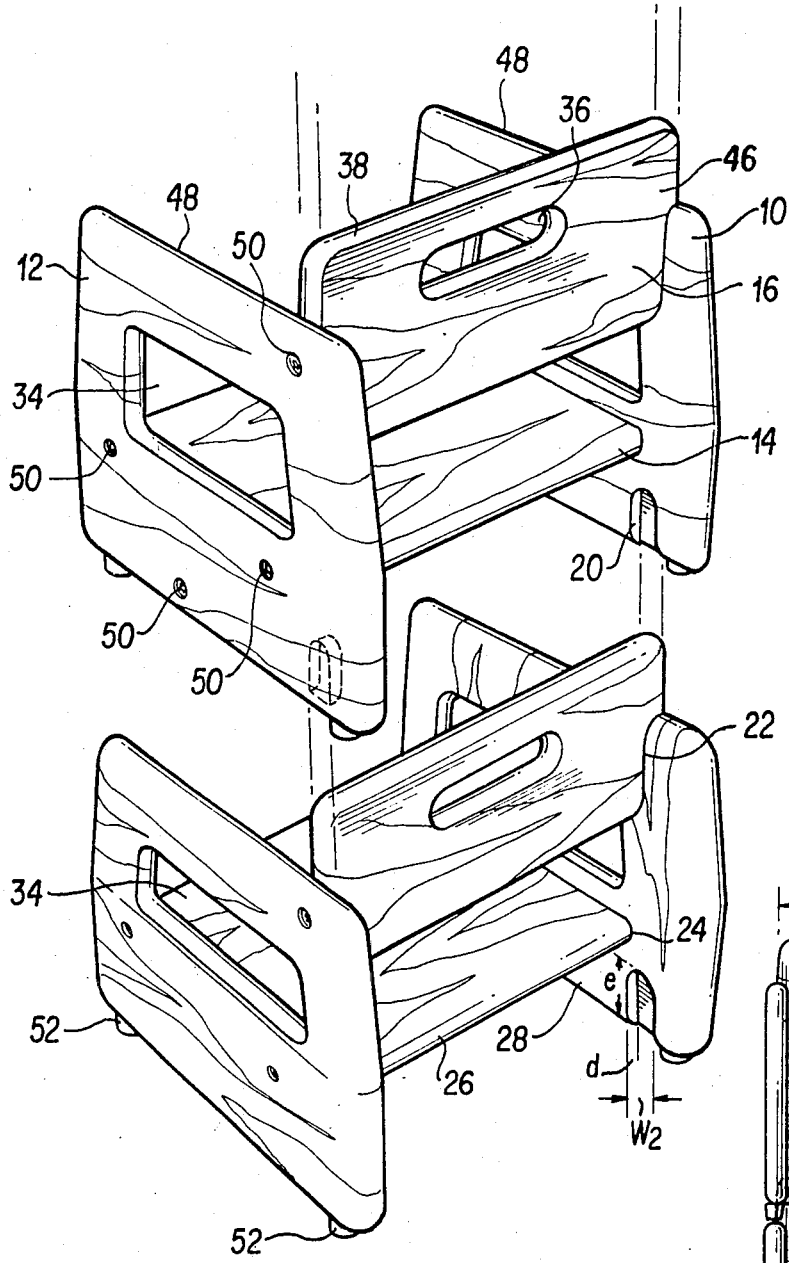
FIG. 1 is an exploded perspective view of two chairs of the invention illustrating the means by which they are engageable with each other.
Figure 2:
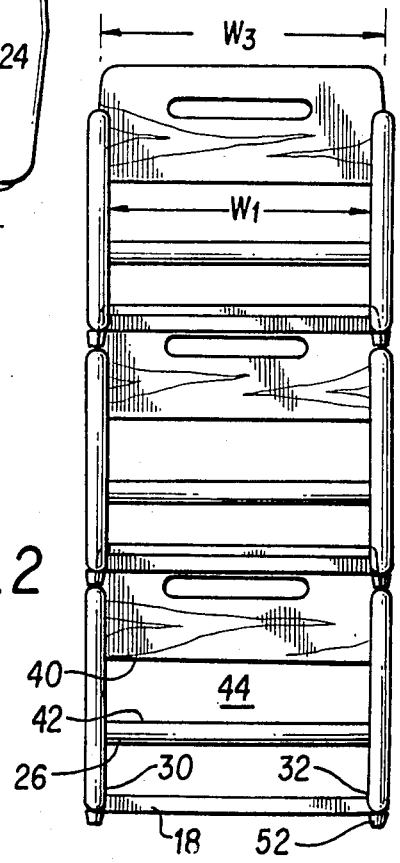
FIG. 2 is a front elevational view of three chairs of the invention stacked upon each other.

A preferred embodiment of the invention is illustrated in the drawings and includes vertical side members 10 and 12 that are spaced apart by a horizontal seat 14, a back rest 16 and a lower brace member 18 (FIG. 2). The lower rear portion of the inside of each side member includes a vertical rabbet 20 and the upper rear portion includes a downwardly-directed, vertical rabbet 22 located directly above the lower rabbet 20. The inner sides of the vertical side members also include a horizontal rabbet 24 located so that the lower edge 26 of the seat member 14 is about 2 and $\frac{5}{8}$ inches or so above the bottoms 28 of the vertical side members 10 and 12 when the ends, not shown, of the seats 14 are affixed in the rabbets 24.

The vertical side members 10 and 12 also include horizontal rabbets at 30 and 32 respectively of FIG. 2 generally centrally located at the lowermost portion of the vertical side members.

The side members 10 and 12 also include cut-out sections 34 to provide ventilation; and, back rest 16 includes a cut-out portion 36 to act as a hand-hold.

As noted above, the lower vertical rabbets 20 are located directly below the back rest 16 and are dimensioned so that the upper portion 38 of the back rest 16 of a first chair is captured within the rabbets 20 of a second chair when placed above each other as illustrated. The relative dimensions of the rabbets 20 and the upper portion 38 of the back rest 16 are significant as is the fact that the thusly-described locking structure is relatively unnoticeable both when the chairs are stacked and when they are used individually. Hence, the booster chairs of the invention, which are preferably made of observably oak grained wood, maintain their simplicity and attractiveness during both use and storage.

Additionally, the lower edge 40 of the back rest 16 (FIG. 2) is spaced about two and a half inches or so above the top 42 of the seat 26 to provide additional ventilation for the child using the booster chair and a convenient surface for engagement with suitable hangers or hooks in the event it is desired to store an individual chair by hanging rather than stacking. That is, the lower surface 40 of the back rest 16 is restable upon and/or engageable with suitable brackets, hooks, or the like which are insertable through the space 44 between the upper edge 42 of the seat 26 and the lower edge 40 of the back rest 16.

In a preferred embodiment the booster chair was constructed of nominal one inch thick oak having a finished dimension of three quarters of an inch. In this respect, the width $W_2$ of the vertical rabbets 20 was about 13/16" to permit a clearance of about 1/16" from the upper portions 46 of the back 16. Similarly, the depth "d" of the vertical rabbets 20 was about $\frac{5}{8}$" and the vertical extent "e" was about $1\frac{3}{8}$" to provide clearances of about 1/16" in the vertical and horizontal directions between the portions 46 of the back rest and the vertical rabbets 20.

The upper edge 38 of the back rest extended about 1 5/16" above the arm-rest portions 48 of the vertical side members 10 and 12 and had a width $W_3$ that was greater than the width $W_1$ between the side members 10 and 12 by about ½"(¼" on each side of the chair). These preferred clearances, of course, can be varied. Except as noted below, however, it is significant that the back rest is located directly above the vertical rabbets 20; that the upper portions 46 of the back rest extend over the arm-rest portion 48 of the sides; that the rabbets 20 not be visible when the chair is viewed in side elevation; and, that the clearances between the vertical rabbet 20 and the upper back rest portions 46 be sufficient to provide easy engagement and disengagement, but small enough to result in a stable locking arrangement when a plurality of chairs are stacked as illustrated. The dimensions of the cut-out portions 34 and 36, however, are quite optional so long as the hand-hold 36 is serviceable and the side cut-out provides adequate ventilation commensurate with an attractive, sturdy structure.

The various elements described above are fastened together by suitable means such as by means of suitable fasteners such as screws 50 having the heads thereof countersunk as illustrated and covered with screw caps.

Finally, a preferred embodiment also includes flexible feet such as rubber elements 52 for reducing slippage when the chairs are used to boost a child above a somewhat slippery surface; and, to reduce marring of both the surface above which the child is boosted and the arm rests 48 of the chair below when the booster chairs are in their stacked position. Depending upon the size of the members 52, it might be desirable to modify the vertical extent of the rabbets 20 and/or the extent of the back rest 16 above the arm-rests 48.

The above-described structure provides a simple, sturdy, and attractive booster chair that is suitable for both individual use in a home or for stackable use in restaurants or the like in a manner so that the locking structure used during stacking is relatively unobtrusive during use of individual chairs. At the same time, the above-described locking structure is sturdy and inexpensive without the need for special or dangerously-protruding elements as are required on most stackable chairs of the prior art.

While the invention has been particularly shown and described with reference to the preferred embodiment thereof, it will be understood by those skilled in the art that various alterations in form and detail may be made therein without departing from the spirit and scope of the invention. For example, the rabbets 20 and 22 need not be vertical, but can be somewhat inclined from the vertical so long as they are located in vertical alignment and can be locked in their stacked position as described above.

The embodiments of the invention in which an exclusive property or privilege is claimed are defined as follows:

1. A stackable children's booster chair comprising:

a pair of vertical side members each having front, rear, upper, and lower portions and having inner and outer sides, said inner sides being spaced apart by a distance $W_1$;

a substantially vertical rabbet having a depth "d", a width $W_2$ and an upward vertical extent "e" into the lower rear portion of said inner side of each of said vertical side members;

a horizontal seat member having a width at least as large as $W_1$ and extending between said vertical side members;

a substantially vertical back member extending between the upper rear portions of said pair of vertical side members and located directly above said vertical rabbet;

said back member having an upper portion having a thickness that is less than said width $W_2$ of said vertical rabbet and extending above said upper portions of said side members by a distance less than said vertical extent "e" and having a width $W_3$ that is greater than $W_1$, but less than $(W_1+2d)$ so that a vertical rabbet of a second such booster chair is slidable over and engageable with said upper portion of said back member when a second such booster chair is placed on top of said booster chair, whereby a plurality of such booster chairs are lockably stackable each upon the other.

2. The chair of claim 1 wherein said horizontal seat member is rabbeted into said vertical side members.

3. The chair of claim 1 wherein said substantially vertical back member is rabbeted into said vertical side members.

4. The chair of claim 1 including a brace member extending between the lower portion of said vertical side members.

5. The chair of claim 4 wherein said brace is centrally located between the front and rear portions of said side members and is rabbeted into said side members.

6. The chair of claim 1 including ventilation-openings in said vertical side members and located above said horizontal seat member.

7. The chair of claim 1 including a ventilation space between said horizontal seat member and said back member.

8. The chair of claim 7 including ventilation-openings in said vertical side members and located above said horizontal seat member.

9. The chair of claim 7 including means on said vertical back member for permitting engagement thereof with a hanging means.

10. The booster chair of claim 1 wherein said back member includes a hand-hold means.

11. The chair of claim 1 including a plurality of foot members located on the bottoms of said vertical side members and adapted to engage with the upper portion of the vertical side members of the chair therebelow when stacked.

12. A stackable childrens'booster chair comprising:

a pair of vertical side members each having front, rear, upper, and lower portions and having inner and outer sides, said inner sides being spaced apart by a distance $W_1$;

a first substantially vertical rabbet having a depth "d", a width $W_2$, and an upward vertical extent "e" into the lower rear portion of said inner side of each of said vertical side members;

a second vertical rabbet located vertically above and in line with said first rabbet and extending downwardly from the upper rear portion of said inner side of each of said vertical side members;

a horizontal rabbet in the inner side of each of said vertical side members and located between the maximum vertical extents of said first and second vertical rabbets;

a horizontal seat member extending between said vertical side members having ends thereof extending into said horizontal rabbets; and, a substantially vertical back member having a lower portion extending into said second vertical rabbets and extending between the upper rear portions of said pair of vertical side members;

means for retaining said horizontal seat member and said vertical back member in their respective rabbets;

said back member having an upper portion having a thickness that is less than said width $W_2$ of said vertical rabbet and extending above said upper portions of said side members by a distance less than said vertical extent e and having a width $W_3$ that is greater than $W_1$, but less than $(W_1+2d)$ so that a vertical rabbet of a second such booster chair is slidable over and engageable with said upper portion of said back member when a second such booster chair is placed on top of said booster chair, whereby a plurality of such booster chairs are lockably stackable each upon the other.

13. The seat of claim 12 including a brace member extending between the lower portion of said vertical side members.

14. The seat of claim 13 wherein said brace is centrally located between the front and rear portions of said side members and is rabbeted into said side members.

15. The seat of claim 13 including a plurality of foot members located on the bottoms of said vertical side members and adapted to engage with the upper portion of the vertical side members of the chair therebelow when stacked.

16. The seat of claim 12 including ventilation-openings in said vertical side members and located above said horizontal seat member.

17. The seat of claim 12 including a ventilation space between said horizontal seat member and said back member.

18. The seat of claim 17 including ventilation-openings in said vertical side members and located above said horizontal seat member.

19. The seat of claim 12 including means on said vertical back member for permitting engagement thereof with a hanging means.

20. The booster chair of claim 12 wherein said back member includes a hand-hold means.

21. A stackable childrens' booster chair comprising:

a pair of vertical side members each having front, rear, upper, and lower portions and having inner and outer sides, said inner sides being spaced apart by a distance $W_1$;

a first substantially vertical rabbet having a depth "d", a width $W_2$, and an upward vertical extent "e" into the lower rear portion of said inner side of each of said vertical side members;

a second vertical rabbet located vertically above and in line with said first rabbet and extending downwardly from the upper rear portion of said inner side of each of said vertical side members;

a horizontal rabbet in the inner side of each of said vertical side members and located between the maximum vertical extent of said first and second vertical rabbets;

a horizontal seat member extending between said vertical side members and having ends thereof extending into said horizontal rabbets;

a substantially vertical back member having a lower portion extending into said second vertical rabbets and extending between the upper rear portions of said pair of vertical side members;

means for retaining said horizontal seat member and said vertical back member in their respective rabbets;

a second horizontal rabbet centrally located in said lower portion of each of said vertical side members;

brace means extending between said vertical side members into said second horizontal rabbets;

fastening means for affixing said seat and said back and said brace means to said vertical side members;

a ventilation space between said horizontal seat member and said back member;

ventilation-openings in said vertical side members and located above said horizontal seat member;

means on said vertical back member for permitting engagement thereof with a hanging means;

said back member having an upper portion having a thickness that is less than said width $W_2$ of said vertical rabbet and extending above said upper portions of said side members by a distance less than said vertical extent e and having a width $W_3$ that is greater than $W_1$, but less than $(W_1+2d)$ so that a vertical rabbet of a second such booster chair is slidable over and engageable with said upper portion of said back member when a second such booster chair is placed on top of said booster chair, whereby a plurality of such booster chairs are lockably stackable each upon the other.

22. The stackable children's booster chair of claim 21 wherein said back member includes a hand-hold means.

23. The stackable children's booster chair of claim 21 including a plurality of foot members located on the bottoms of said vertical side members and adapted to engage with the upper portion of the vertical side members of the chair therebelow when stacked.

* * * * *